US010308334B2

(12) United States Patent
Kang et al.

(10) Patent No.: US 10,308,334 B2
(45) Date of Patent: Jun. 4, 2019

(54) SELF-DRAINING OIL BUOYANCY REGULATING DEVICE FOR UNDERWATER ROBOTS

(71) Applicant: ZHEJIANG UNIVERSITY, Hangzhou, Zhejiang (CN)

(72) Inventors: Changlin Kang, Zhejiang (CN); Chunlin Zhou, Zhejiang (CN); Rong Xiong, Zhejiang (CN); Qi Zhu, Zhejiang (CN); Qiuguo Zhu, Zhejiang (CN); Yong Liu, Zhejiang (CN)

(73) Assignee: ZHEJIANG UNIVERSITY, Hangzhou, Zhejiang (CN)

( * ) Notice: Subject to any disclaimer, the term of this patent is extended or adjusted under 35 U.S.C. 154(b) by 0 days.

(21) Appl. No.: 15/326,475

(22) PCT Filed: Oct. 19, 2015

(86) PCT No.: PCT/CN2015/092177
§ 371 (c)(1),
(2) Date: Jan. 14, 2017

(87) PCT Pub. No.: WO2017/066906
PCT Pub. Date: Apr. 27, 2017

(65) Prior Publication Data
US 2018/0208284 A1 Jul. 26, 2018

(51) Int. Cl.

| | |
|---|---|
| ***B63G 8/24*** | (2006.01) |
| ***B63G 8/22*** | (2006.01) |
| ***B63C 11/52*** | (2006.01) |
| *F04B 49/06* | (2006.01) |

(52) U.S. Cl.
CPC ..... *B63G 8/24* (2013.01); *B63C 11/52* (2013.01); *B63G 8/22* (2013.01); *F04B 49/065* (2013.01)

(58) Field of Classification Search
CPC .... B63G 8/00; B63G 8/22; B63G 8/24; F04B 49/065
USPC ..... 114/331, 333; 367/18
See application file for complete search history.

(56) References Cited

U.S. PATENT DOCUMENTS 3,228,369 A * 1/1966 Warhurst ..... B63G 8/24 114/331
5,379,267 A * 1/1995 Sparks ..... B63B 22/18 367/18
6,772,705 B2 * 8/2004 Leonard ..... B63G 8/24 114/333

(Continued)

*Primary Examiner* — Lars A Olson

(57) ABSTRACT

The present invention provides a self-draining oil buoyancy regulating device for underwater robots, wherein the accumulator, lower hatch cover, hatch trunk, upper hatch cover and bladder are connected; the water-proof connector is fixed on the upper hatch cover; the depth-pressure sensor is settled on the lower hatch cover; the upper valve block, hydraulic-operated check valve and lower valve block are connected; the lower valve block is fixed on the lower hatch cover; the pump outlet pressure sensor and the accumulator pressure sensor are on the lower valve block; the directional valve and the upper valve block are connected; the hydraulic pump motor assembly and the relief valve are both connected with the lower valve block; the depth-pressure sensor, pump outlet pressure sensor and accumulator pressure sensor are all connected with the control panel; the control panel is connected with the external power supply and the host computer.

4 Claims, 7 Drawing Sheets

(56) References Cited

U.S. PATENT DOCUMENTS

| | | | | |
|---|---|---|---|---|
| 2009/0178603 | A1* | 7/2009 | Imlach | B63G 8/22<br>114/331 |
| 2012/0289103 | A1* | 11/2012 | Hudson | B63G 8/22<br>114/331 |
| 2013/0239870 | A1* | 9/2013 | Hudson | B63G 8/22<br>114/333 |

* cited by examiner

SELF-DRAINING OIL BUOYANCY REGULATING DEVICE FOR UNDERWATER ROBOTS

CROSS REFERENCE OF RELATED APPLICATION

This is a U.S. National Stage under 35 U.S.C 371 of the International Application PCT/CN2015/092177, filed Oct. 19, 2015.

BACKGROUND OF THE PRESENT INVENTION

Field of Invention

The present invention relates to a buoyancy regulating device, and more particularly to a self-draining oil buoyancy regulating device for underwater robots.

Description of Related Arts

Underwater robots and other underwater appliances work in different depth under the water, which requires a control over the movement and depth in the water. The underwater environment makes the energy supply hard so control the buoyancy by active propelling is impossible, which makes the buoyancy regulating device necessary for the appliances to regulate the buoyancy and move up and down.

The conventional methods for regulating the buoyancy are mechanical transmission, active oil pumping, load rejection, water drainage and phase change.

Mechanical transmission method adopts a series of mechanical transmission to adjust the volume of the appliance by changing the position of the execution parts to regulate the buoyancy, which needs mechanical self-locking structure to keep the volume of the appliance unchanged during a period of time. To overcome the static friction caused by maintaining the self-locking consumes energy, which wastes the energy and cause low efficiency. Compared to other methods the mechanical transmission adopts transmission parts, which is heavier in weight and bigger in volume when regulating same buoyancy. Besides changing the relative position of the rigid bodies by piston makes the sealing underwater a difficult problem to solve compared to other methods and reduces the reliability. For example the basic theory of a most commonly used method for regulating the buoyancy is to drive the piston to change the volume of the liquid (sea water or oil) inside the piston cylinder by motor through screw rod. The reciprocating motion of the piston inside the cylinder undermines the reliability due to the sealing problem.

The active oil pumping method is to pump the hydraulic oil into the oil bag through oil channel and change volume of displacement by changing the volume of the oil bag, which further regulates the buoyancy. Same as the mechanical transmission method the active oil pumping also needs the self-locking to maintain the volume of the appliance unchanged during a period of time. The conventional hydraulic system has complex valve system which increases the weight and volume of the appliance. All the oil channels are acting during the oil draining, which is passive oil drainage and is classified as active oil return and passive oil return according to whether the adopted pump is one-way or two-way. The problem of the passive oil drainage and active oil return plan is when the water is shallow and the external pressure is lower than the friction loss the active oil return fails. The problem of passive oil drainage and passive oil return is that a two-way pump is needed. Under the same flow pressure the cost, weight and volume of the two-way pump are bigger than that of the one-way pump. The hydraulic pump is on during the oil return and oil drainage, which consumes the energy. The two-way pump is unable to quick switch between forward and reversal rotation, which affects the control performance.

The method of load rejection is to control the buoyancy by throwing away the weight to reduce the self-gravitation, which is irreversible and makes the appliance moves up one time. The method of water drainage is to adjust the water displacement and suction by releasing or compressing the high-pressure gas. The compression of high pressure gas is accomplished by water pump, which is hard to control due to the process of gas compression is nonlinear and tend to be affected by many factors. The water pump is not reliable and has short service life if stay in the sea for a long time. The method of phase change is to regulate the buoyancy by the change in volume of specific medium during the process of phase change. The phase change is a complex nonlinear thermodynamic process and the gas generated is easy to be compressed, which is hard to control.

SUMMARY OF THE PRESENT INVENTION

An object of the present invention is to provide a self-draining oil buoyancy regulating device for underwater robots, which is a buoyancy regulating solution has the advantages of stable, easy to control, quick switch between oil drainage and oil return, low energy consumption, compact structure, light weight and small volume. The present invention is applied in the buoyancy and depth control for underwater appliance.

In order to accomplish the above object, the present invention provides a self-draining oil buoyancy regulating device for underwater robots, comprising: an accumulator, a lower hatch cover, a lower valve block, a hydraulic-operated check valve, an upper valve block, a pump outlet pressure sensor, an accumulator pressure sensor, a depth-pressure sensor, a hydraulic pump motor assembly, a directional valve, a relief valve, a control circuit board, a hatch shell, an upper hatch cover, a bladder, a water-proof connector and host computer, wherein the accumulator, the lower hatch cover, the hatch shell, the upper hatch cover and the bladder are fixedly connected in sequence; the water-proof connector is fixed on the upper hatch cover;

The depth-pressure sensor is settled on the lower hatch cover to check the underwater pressure; the upper valve block, the hydraulic-operated check valve and the lower valve block is connected though piping in sequence; the lower valve block is fixed on the lower hatch cover;

The pump outlet pressure sensor and the accumulator pressure sensor are settled on the lower valve block; the directional valve and the upper valve block are connected through piping; the hydraulic pump motor assembly and the relief valve are both connected with the lower valve block through piping;

The depth-pressure sensor, the pump outlet pressure sensor and the accumulator pressure sensor are all connected with the control panel; the control panel is connected with the external power supply and the host computer respectively by the water-proof connector;

Furthermore on a top surface of the lower valve block there are a lower valve block $10^{th}$ port, a lower valve block $11^{th}$ port and a lower valve block $12^{th}$ port; on sides of the lower valve block there are a lower valve block $2^{nd}$ port, a lower valve block $3^{rd}$ port, a lower valve block $4^{th}$ port, a lower valve block $5^{th}$ port, a lower valve block $6^{th}$ port, a lower valve block $7^{th}$ port, a lower valve block $8^{th}$ port and a lower valve block $9^{th}$ port; on the bottom surface of the lower valve block there is a lower valve block $1^{st}$ port; inside the lower valve block there are runners, wherein the lower valve block $2^{nd}$ port, the lower valve block $3^{rd}$ port, the lower valve block $9^{th}$ port and the lower valve block $12^{th}$ port are connected by a first runner; the lower valve block $1^{st}$ port, the lower valve block $7^{th}$ port, the lower valve block $8^{th}$ port and the lower valve block $11^{th}$ port are connected by a second runner; the lower valve block $4^{th}$ port, the lower valve block $5^{th}$ port, the lower valve block $6^{th}$ port and the lower valve block $10^{th}$ port are connected by a third runner;

wherein the lower valve block $1^{st}$ port is connected with the accumulator through the lower hatch cover; the lower valve block $2^{nd}$ port is connected with an oil draining outlet of the hydraulic pump motor assembly; the lower valve block $3^{rd}$ port is connected with an oil inlet of the relief valve; the lower valve block $4^{th}$ port is connected with an oil outlet of the relief valve; the lower valve block $5^{th}$ port is connected with an oil return outlet of the hydraulic pump motor assembly; the lower valve block $6^{th}$ port is connected with the bladder; the lower valve block $7^{th}$ port, the lower valve block $8^{th}$ port and the lower valve block $9^{th}$ port are blocked; the lower valve block $10^{th}$ port is connected with an oil return outlet of the hydraulic-operated check valve; the lower valve block $11^{th}$ port is connected with a first working port of the hydraulic-operated check valve; the lower valve block $12^{th}$ port is connected with an oil inlet of the hydraulic-operated check valve;

Furthermore on the upper valve block there are an upper valve block $1^{st}$ port, an upper valve block $2^{nd}$ port, an upper valve block $3^{rd}$ port, an upper valve block $4^{th}$ port; wherein a second working port of the directional valve is connected with a second working port of the hydraulic-operated check valve through the upper valve block $1^{st}$ port; an oil outlet of the directional valve is connected with an oil return outlet of the hydraulic-operated check valve through the upper valve block $2^{nd}$ port; a first working port of the directional valve is connected with the first working port of the hydraulic-operated check valve through the upper valve block $3^{rd}$ port; an oil inlet of the directional valve is connected with the oil inlet of the hydraulic-operated check valve through the upper valve block $4^{th}$ port;

The control panel further comprising: a first power supply module, a second power supply module, a communication drive module, a voltage reference stabilizing module, a first filter module, a second filter module, a third filter module, AD converter module and single-chip microcomputer; wherein the first power supply module transfers an external 12V power supply to an internal 12V power supply inside the control panel; the second power supply module transfers an internal 12V power supply inside the control panel to a 5V power supply for the single-chip microcomputer; the first power supply module is connected to the second power supply module and the voltage reference stabilizing module respectively; input ends of a power supply of the pump outlet pressure sensor, the accumulator pressure sensor, the depth-pressure sensor, the hydraulic pump motor assembly and the directional valve are all connected with the second power supply module; a signal cable of the depth-pressure sensor is connected with the first filter module; a signal cable of the pump outlet pressure sensor is connected with the second filter module; a signal cable of the accumulator pressure sensor is connected with the third filter module; the first filter module, the second filter module, the third filter module and the voltage reference stabilizing module are all connected with the AD converter module; the AD converter module is connected with an input end of the single-chip microcomputer; control cables of the hydraulic pump motor assembly and the directional valve (23) are connected with an output end of the single-chip microcomputer; the communication drive module is connected with the single-chip microcomputer; the first power supply module is connected with the external power supply through a power cord of the water-proof connector; the communication drive module is connected with the host computer through a signal cable of the water-proof connector.

Compared to the conventional technology the present invention has following benefits:

1. By adopting a whole hydraulic plan, there are no other movement components except the pump and motor. All the key sealing parts are static seal, which makes the mechanical transmission has reliable sealing and has long service life.
2. Realize the active oil drainage and passive oil return by taking the advantage of the accumulator, which reduces the energy consumption and increases the energy efficiency. At the mean time the problem of the active oil return failure if the water is shallow and the external pressure is lower than the friction loss. Compared to the conventional hydraulic solution by adopting the present invention the working duration under the water is prolonged; the stability is improved; and the quick switch between the oil drainage and oil return is fulfilled. The accumulator is a standard component which is low in cost and easy to find.
3. By adopting the directional valve and the relief valve, the oil channel is simplified. By using the hydraulic-operated check valve and building a self-locking oil channel accordingly the leakage of the accumulator inside the oil channel is reduced without compromise the function, which enhances the security. The valve block assembly reduces the whole assembling volume of the oil channel and makes the appliance compact.

Figure 1:
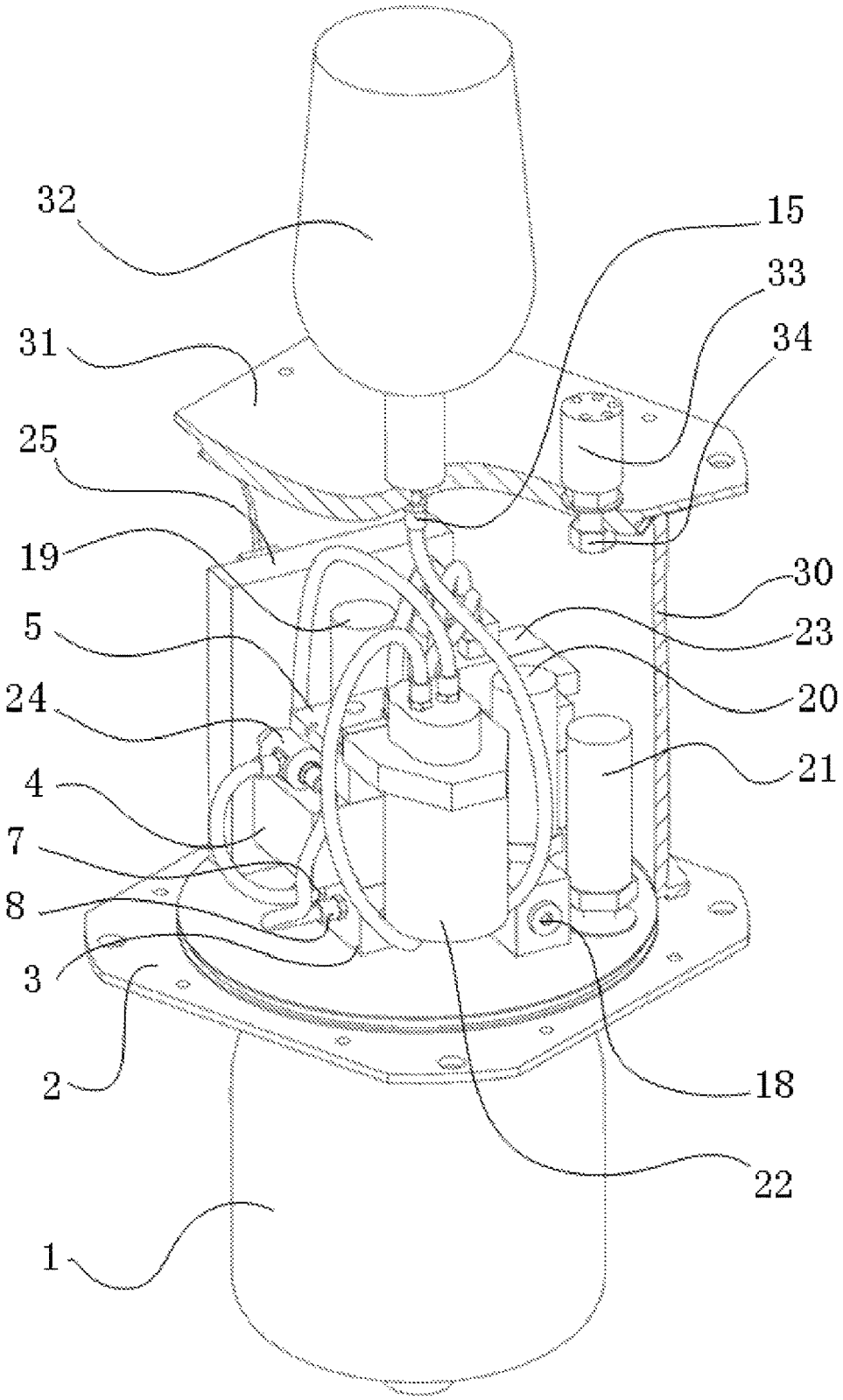
FIG. 1 is a perspective appearance of the present invention.

Element reference: accumulator 1, lower hatch cover 2, lower valve block 3, hydraulic-operated check valve 4, upper valve block 5, $1^{st}$ oil pipe connector 6, $2^{nd}$ oil pipe connector 7, $3^{rd}$ oil pipe connector 8, $4^{th}$ oil pipe connector 9, $5^{th}$ oil pipe connector 10, $6^{th}$ oil pipe connector 11, $7^{th}$ oil pipe connector 12, $8^{th}$ oil pipe connector 13, $9^{th}$ oil pipe connector 14, $10^{th}$ oil pipe connector 15, $1^{st}$ oil channel plug 16, $2^{nd}$ oil channel plug 17, $3^{rd}$ oil channel plug 18, pump outlet pressure sensor 19, accumulator pressure sensor 20, depth-pressure sensor 21, hydraulic pump motor assembly 22, directional valve 23, relief valve 24, control panel 25, $1^{st}$ bolt 26, $2^{nd}$ bolt 27, $3^{rd}$ bolt 28, $4^{th}$ bolt 29, hatch shell 30, upper hatch cover 31, bladder 32, water-proof connector 33, nut 34, lower valve block $1^{st}$ port 35, lower valve block $2^{nd}$ port 36, lower valve block $3^{rd}$ port 37, lower valve block $4^{th}$ port 38, lower valve block $5^{th}$ port 39, lower valve block $6^{th}$ port 40, lower valve block $7^{th}$ port 41, lower valve block $8^{th}$ port 42, lower valve block $9^{th}$ port 43, lower valve block $10^{th}$ port 44, lower valve block $11^{th}$ port 45, lower valve block $12^{th}$ port 46, upper valve block $1^{st}$ port 47, upper valve block $2^{nd}$ port 48, upper valve block $3^{rd}$ port 49, upper valve block $4^{th}$ port 50.

DETAILED DESCRIPTION OF THE PREFERRED EMBODIMENT

Referring to FIG. 1 to FIG. 11 of the drawings, according to a preferred embodiment of the present invention is illustrated, comprising: accumulator 1, lower hatch cover 2, lower valve block 3, hydraulic-operated check valve 4, upper valve block 5, $1^{st}$ oil pipe connector 6, $2^{nd}$ oil pipe connector 7, $3^{rd}$ oil pipe connector 8, $4^{th}$ oil pipe connector 9, $5^{th}$ oil pipe connector 10, $6^{th}$ oil pipe connector 11, $7^{th}$ oil pipe connector 12, $8^{th}$ oil pipe connector 13, $9^{th}$ oil pipe connector 14, $10^{th}$ oil pipe connector 15, $1^{st}$ oil channel plug 16, $2^{nd}$ oil channel plug 17, $3^{rd}$ oil channel plug 18, pump outlet pressure sensor 19, accumulator pressure sensor 20, depth-pressure sensor 21, hydraulic pump motor assembly 22, directional valve 23, relief valve 24, control panel 25, $1^{st}$ bolt 26, $2^{nd}$ bolt 27, $3^{rd}$ bolt 28, $4^{th}$ bolt 29, hatch shell 30, upper hatch cover 31, bladder 32, water-proof connector 33, nut 34 and several oil pipes; wherein an overlay hydraulic-operated check valve 4 with a model MPCV-02W is adopted while other model type is also applicable; a water-proof connector 33 with a model BH5F is adopted while other model type is also applicable; a diaphragm accumulator with a model type Careland AD1.4-140-2x is adopted; Pressure transmitters with a model type KYB2003-04M1P3C1-I (0-1.6 MPa) made by Kang Yu-control are adopted as the pump outlet pressure sensor 19, the accumulator pressure sensor 20 and the depth-pressure sensor 21 while other model type is also applicable; a bladder 32 for accumulator model NXQ1 is adopted while other type is also applicable.

Figure 3:
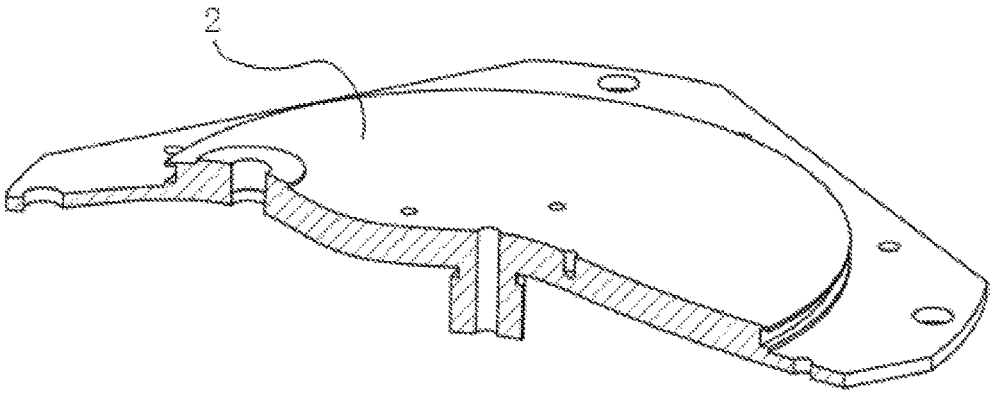
FIG. 3 is an external sectional view of the lower hatch cover of the present invention.

As illustrated in FIG. 3, the lower hatch cover 2 is in flange plate shape. On the geometry center of the bottom of the lower hatch cover there is a male threaded cylinder. On the top surface of the lower hatch cover 2 there are 4 threaded blind holes, a pipe taper threaded through hole to fix the depth-pressure sensor 21 and a through-hole at the geometry center of the top surface. There is a groove on the side of the upper part of the lower hatch cover 2 containing a sealing ring. There are 8 through holes and 4 through holes for external connection distributed evenly in circumferential direction of the flange shaped lower hatch cover 2. The accumulator 1 is connected with the male threaded cylinder on the bottom of lower hatch cover 2.

Figure 4:
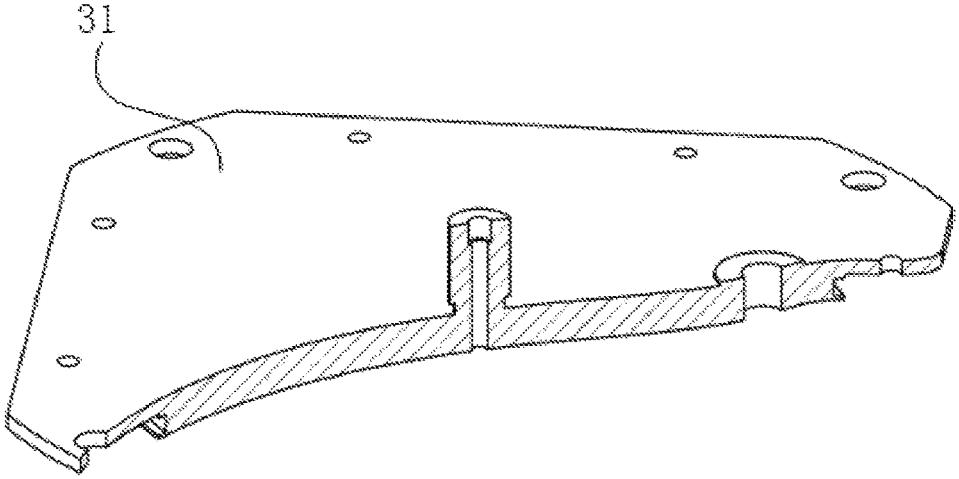
FIG. 4 is an external sectional view of the upper hatch cover of the present invention.

As illustrated in FIG. 4, the upper hatch cover 31 is in flange plate shape. On the geometry center of the top of the upper hatch cover there is a male threaded cylinder. There is a groove on the side of the bottom of the upper hatch cover 31 containing a sealing ring. There are 8 through holes and 4 through holes for external connection distributed evenly on the flange shaped upper hatch cover 31. The bladder 32 is connected with the male threaded cylinder on the top of upper hatch cover 31. On the geometry center of the upper hatch cover 31 there is threaded hole to fix the $10^{th}$ oil pipe connector 15. There is an embossment on the top of upper hatch cover 31. On the geometry center of the embossment there is a through hole to fix the water-proof connector 33.

Figure 5:
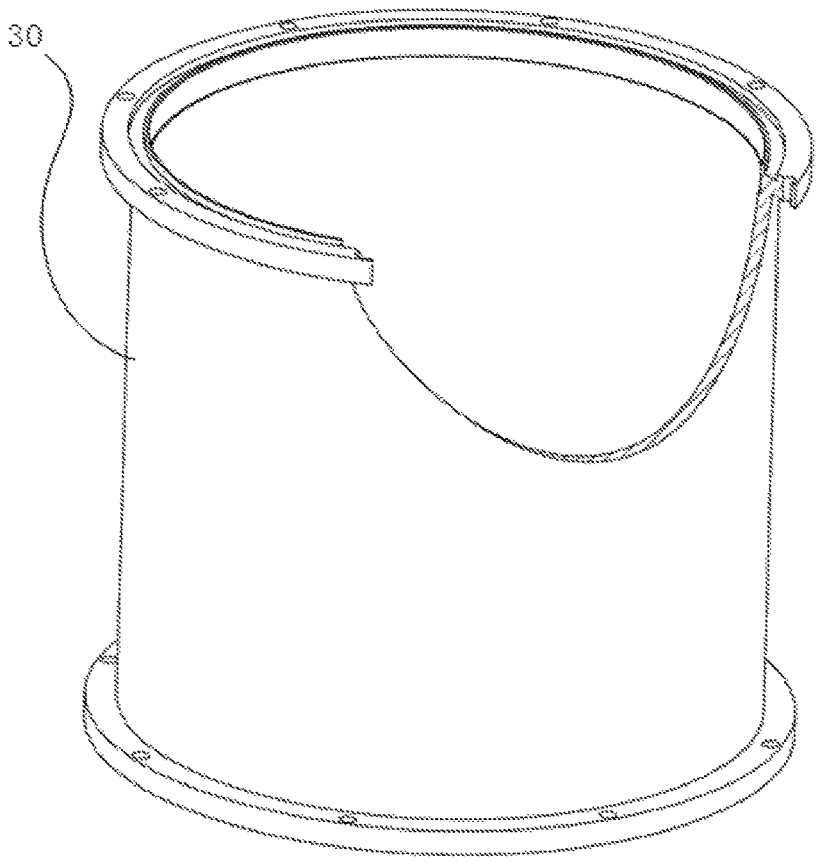
FIG. 5 is an external sectional view of the hatch shell of the present invention.
Figure 6:
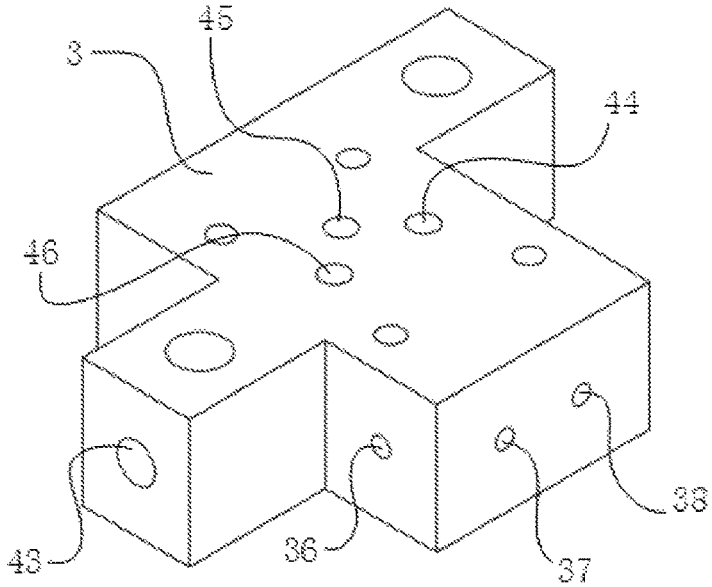
FIG. 6 is an external view of the lower valve block of the present invention.
Figure 7:
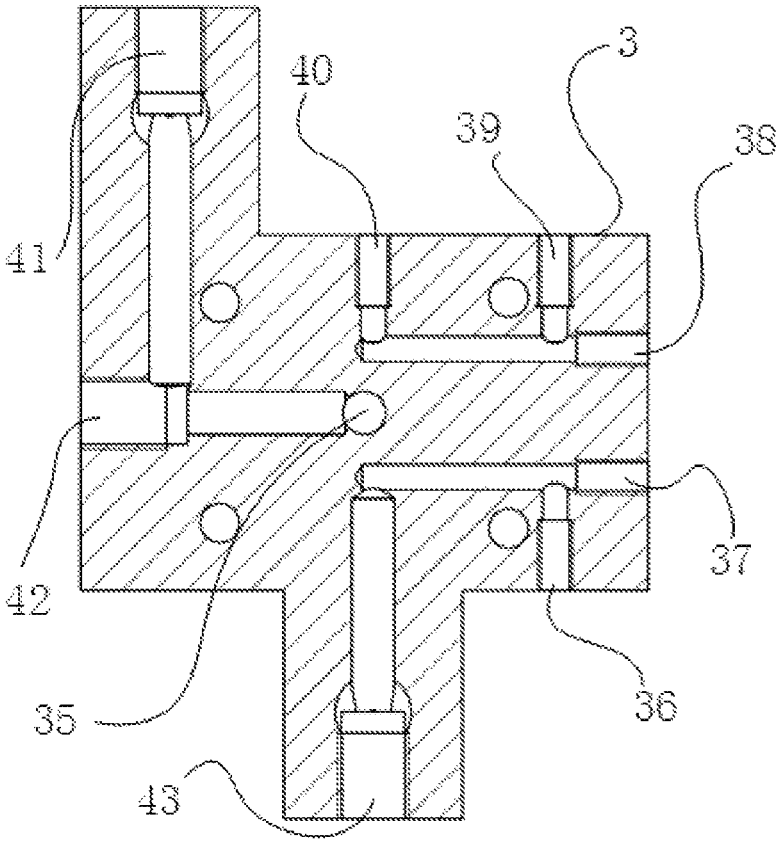
FIG. 7 is a top sectional view of the lower valve block of the present invention.

As illustrated in FIG. 5, the two ends of the hatch shell 30 are in flange plate shape. There are grooves containing sealing rings on the flange plates at the two ends. On each of the flange plates there are 8 through holes. The 8 through holes on the top flange plate are match with the 8 through holes on the upper hatch cove 31. The 8 through holes on the bottom flange plate are match with the 8 through holes on the lower hatch cove 2.

As illustrated in 6 and 7, there are four positioning through holes on the lower valve block 3, on the top surface of the lower valve block 3 there are two pipe taper threaded holes to fix the pump outlet pressure sensor 19 and the accumulator pressure sensor 20;

On a top surface of the lower valve block 3 there are a lower valve block $10^{th}$ port 44, a lower valve block $11^{th}$ port 45 and a lower valve block $12^{th}$ port 46; on sides of the lower valve block 3 there are a lower valve block $2^{nd}$ port 36, a lower valve block $3^{rd}$ port 37, a lower valve block $4^{th}$ port 38, a lower valve block $5^{th}$ port 39, a lower valve block $6^{th}$ port 40, a lower valve block $7^{th}$ port 41, a lower valve block $8^{th}$ port 42 and a lower valve block $9^{th}$ port 43; on the bottom surface of the lower valve block 3 there is a lower valve block $1^{st}$ port 35; inside the lower valve block 3 there are runners, wherein the lower valve block $2^{nd}$ port 36, the lower valve block $3^{rd}$ port 37, the lower valve block $9^{th}$ port 43 and the lower valve block $12^{th}$ port 46 are connected by a first runner; the lower valve block $1^{st}$ port 35, the lower valve block $7^{th}$ port 41, the lower valve block $8^{th}$ port 42 and the lower valve block $11^{th}$ port 45 are connected by a second runner; the lower valve block $4^{th}$ port 38, the lower valve block $5^{th}$ port 39, the lower valve block $6^{th}$ port 40 and the lower valve block $10^{th}$ port 44 are connected by a third runner;

The lower valve block $1^{st}$ port 35 is connected with the accumulator 1 through the through hole on the geometry center of the lower hatch cover 2; the lower valve block $2^{nd}$ port 36 is connected with the $1^{st}$ oil pipe connector 6; the lower valve block $3^{rd}$ port 37 is connected with the $2^{nd}$ oil pipe connector 7; the lower valve block $4^{th}$ port 38 is connected with $3^{rd}$ oil pipe connector 8; the lower valve block $5^{th}$ port 39 is connected with the $4^{th}$ oil pipe connector 9; the lower valve block $6^{th}$ port 40 is connected with the $5^{th}$ oil pipe connector 10; the lower valve block $7^{th}$ port 41 is connected with the $1^{st}$ oil channel plug 16; the lower valve block $8^{th}$ port 42 is connected with the $2^{nd}$ oil channel plug 17; and the lower valve block $9^{th}$ port 43 is connected with the $3^{rd}$ oil channel plug 18; the lower valve block $10^{th}$ port 44 is connected with an oil return outlet of the hydraulic-operated check valve 4; the lower valve block $11^{th}$ port 45 is connected with a first working port of the hydraulic-operated check valve 4; the lower valve block $12^{th}$ port 46 is connected with an oil inlet of the hydraulic-operated check valve 4.

Figure 8:
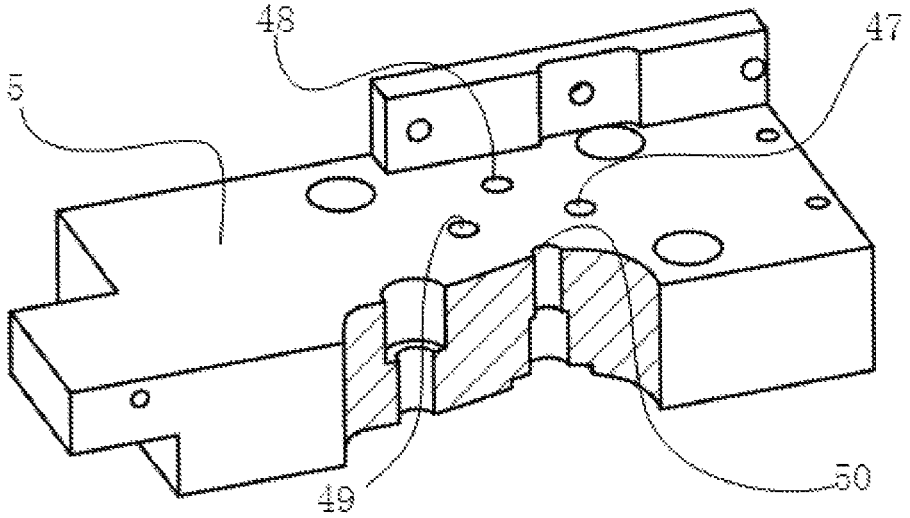
FIG. 8 is an external sectional view of the upper valve block of the present invention.

As illustrated in FIG. 8, there are four positioning through holes on the upper valve block 5; on the upper valve block 5 there are an upper valve block $1^{st}$ port 47, an upper valve block $2^{nd}$ port 48, an upper valve block $3^{rd}$ port 49, an upper valve block $4^{th}$ port 50. There are four runners on the upper valve block 5. The first runner on the upper valve block 5 is connected with the upper valve block $1^{st}$ port 47; the second runner on the upper valve block 5 is connected with the upper valve block $2^{nd}$ port 48; the third runner on the upper valve block 5 is connected with the upper valve block $3^{rd}$ port 49; the fourth runner on the upper valve block 5 is connected with the upper valve block $4^{th}$ port 50; There are embossments on the outlets of the four runners on the upper valve block 5.

The upper valve block $1^{st}$ port 47 is connected with the $9^{th}$ oil pipe connector; the upper valve block $2^{nd}$ port 48 is connected with the $8^{th}$ oil pipe connector 13; the upper valve block $3^{rd}$ port 49 is connected with the $7^{th}$ oil pipe connector 12; the upper valve block $4^{th}$ port 50 is connected with the $6^{th}$ oil pipe connector 11.

Figure 2:
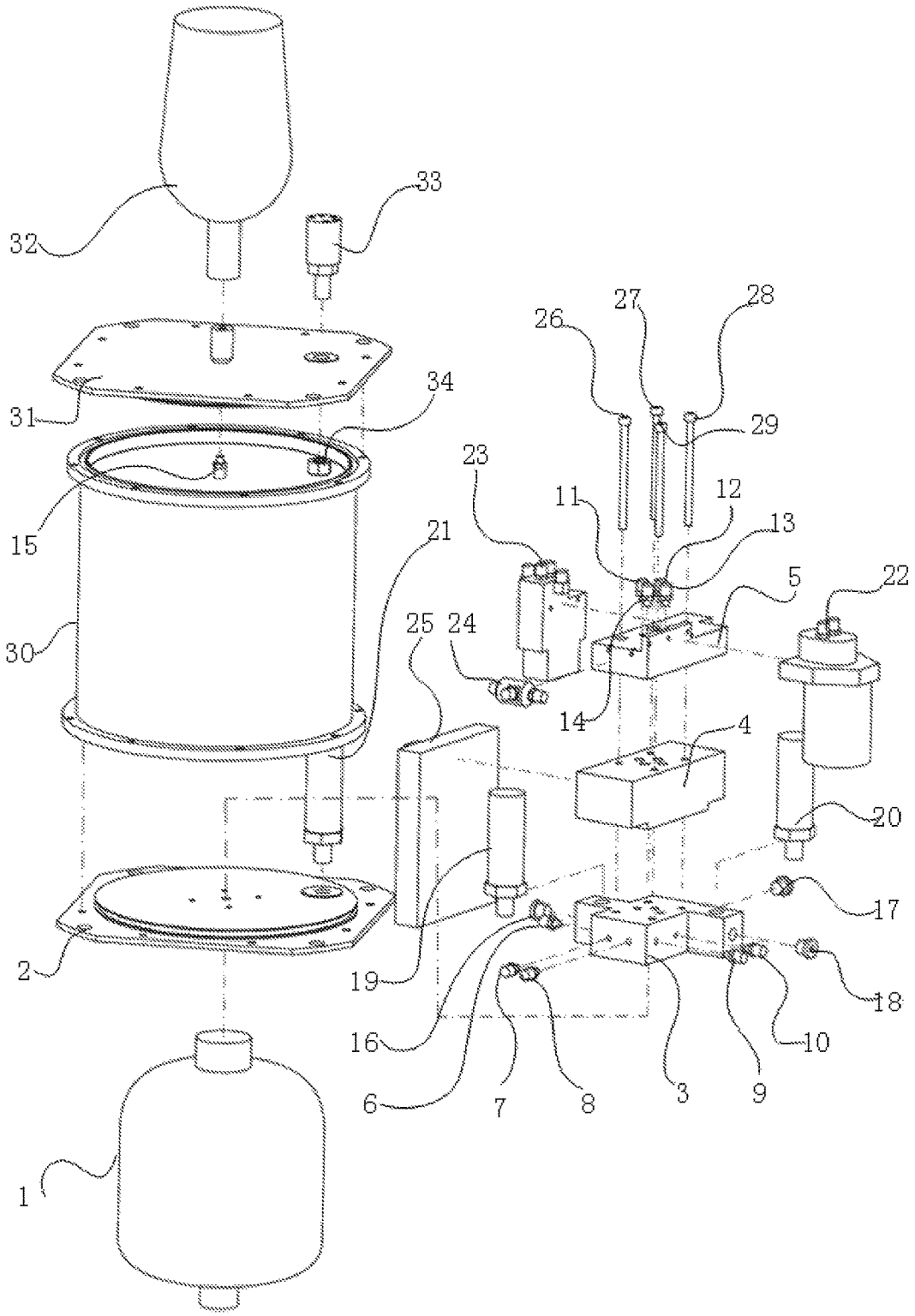
FIG. 2 is an axonometric explosive view of the assembling of the present invention (except oil pipe)

As illustrated in FIG. 1 and FIG. 2, the accumulator 1 is connected with the lower hatch cover 2 by the male threaded cylinder on the bottom; the upper hatch cove 31 is fixed on the top of the hatch shell 30 by a bolt; the lower hatch cover 2 is fixed on the bottom of the hatch shell 30 by a bolt. Both end-face sealing and radial sealing are adopted for the sealing of the upper hatch cover 31 and the lower hatch cover 2 with the hatch shell 30 respectively. The bladder 32 is connected with the upper hatch cover 31 through the male threaded cylinder on the top. The water-proof connector 33 is fixed on the embossment on the top surface of the upper hatch cover 31 by the bolt 34. The $10^{th}$ oil pipe connector 15 is fixed on the geometry center of the bottom of the upper hatch cover 31;

The depth-pressure sensor 21 is fixed on the pipe taper threaded hole on the lower hatch cover 2. The first bolt 26, the second bolt 27, the third bolt 28 and the fourth bolt 29 are threaded through the upper valve block 5 in sequence. The hydraulic-operated check valve 4 and the positioning through hole on the lower valve block 3 are fixed on the lower hatch cover 2. After the upper valve block 5, the hydraulic-operated check valve 4 and the lower valve block 3 are pressed and fixed together, the lower valve block $1^{st}$ port 35 is connected with the through hole on the geometry center of the lower hatch cover 2; the upper valve block $1^{st}$ port 47 is connected with the second working port of the hydraulic-operated check valve 4 through the first runner on the upper valve block 5; the upper valve block $2^{nd}$ port 48 is connected with the oil return outlet of the hydraulic-operated check valve 4 through the second runner on the upper valve block 5; the upper valve block $3^{rd}$ port 49 is connected with the first working port of the hydraulic-operated check valve 4 through the third runner on the upper valve block 5; the upper valve block $4^{th}$ port 50 is fourth runner on the upper valve block 5. The pump outlet pressure sensor 19 and the accumulator pressure sensor 20 are both fixed on the pipe taper threaded hole on the lower valve block 3. The hydraulic pump motor assembly 22, the directional valve 23 and the relief valve 24 are all settled on the upper valve block 5.

The oil draining outlet of the hydraulic pump motor assembly 22 is connected with the $1^{st}$ oil pipe connector 6 through an oil pipe; the oil return outlet of the hydraulic pump motor assembly 22 is connected with the $4^{th}$ oil pipe connector 9 through an oil pipe; the oil inlet of the relief valve 24 is connected with the $2^{nd}$ oil pipe connector 7 through an oil pipe; the oil outlet of the relief valve 24 is connected with the $3^{rd}$ oil pipe connector 8 through an oil pipe; the $5^{th}$ oil pipe connector 10 and the $10^{th}$ oil pipe connector 15 are connected through a oil pipe; the $6^{th}$ oil pipe connector 11 is connected with the oil inlet of the directional valve 23; the $7^{th}$ oil pipe connector 12 is connected with the first working port of the directional valve 23; the $8^{th}$ oil pipe connector 13 is connected with the oil outlet of the directional valve 23; the $9^{th}$ oil pipe connector 14 is connected with the second working port of the directional valve 23; the control panel 25 is fixed on the lower hatch cover 2.

Figure 9:
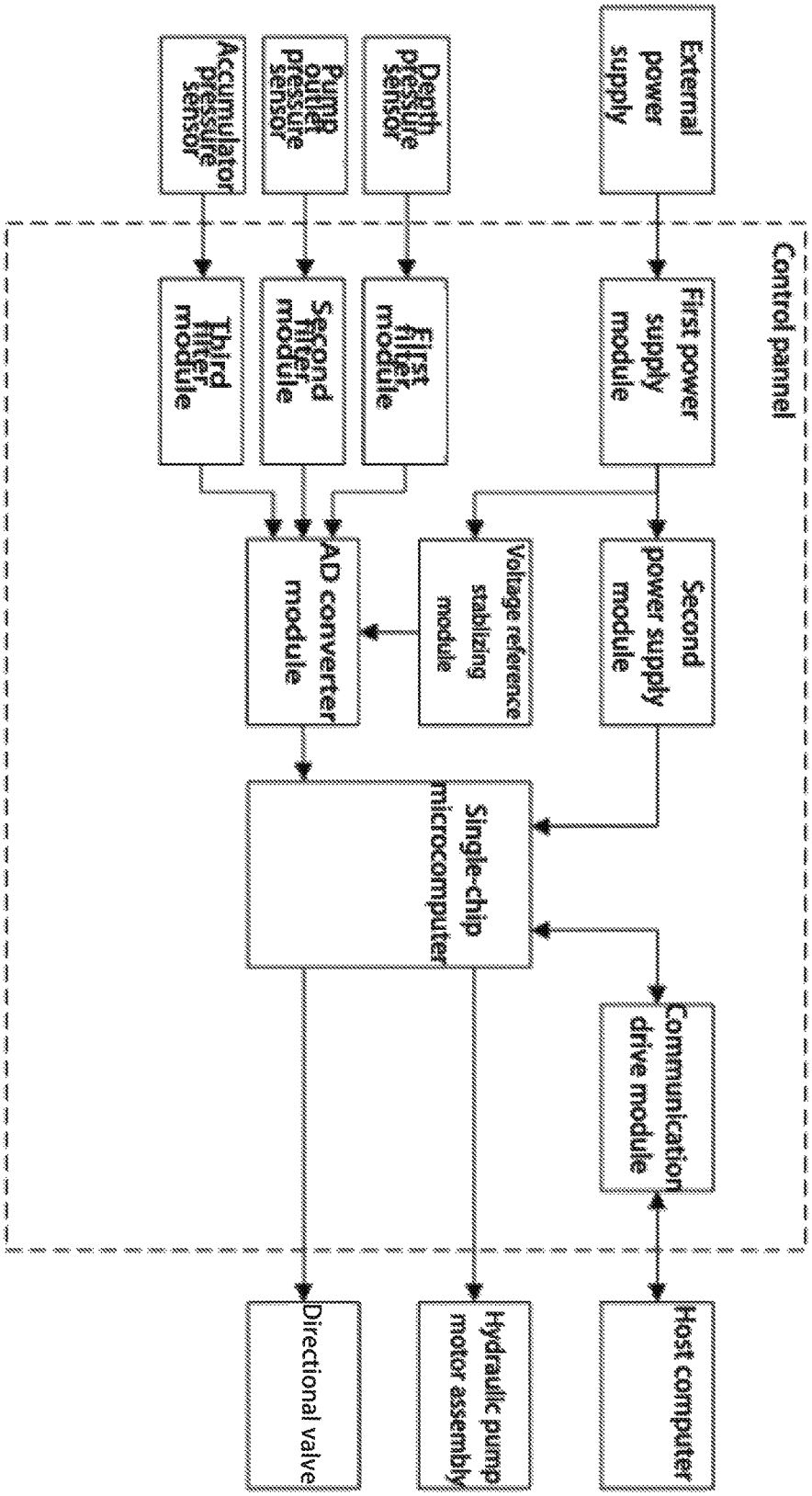
FIG. 9 is a connection diagram of the modules on the control panel of the present invention.

As illustrated in FIG. 9, the control panel 25 comprising: a first power supply module, a second power supply module, a communication drive module, a voltage reference stabilizing module, a first filter module, a second filter module, a third filter module, AD converter module and single-chip microcomputer; wherein the first power supply module is for separation and transfers an external 12V power supply to an internal 12V power supply inside the control panel; the second power supply module transfers an internal 12V power supply output by the first power supply module inside the control panel to a 5V power supply for the single-chip microcomputer; the first power supply module is connected to the second power supply module and the voltage reference stabilizing module respectively; input ends of a power supply of the pump outlet pressure sensor 19, the accumulator pressure sensor 20, the depth-pressure sensor 21, the hydraulic pump motor assembly 22 and the directional valve 23 are all connected with the second power supply module; a signal cable of the depth-pressure sensor 21 is connected with the first filter module; a signal cable of the pump outlet pressure sensor 19 is connected with the second filter module; a signal cable of the accumulator pressure sensor 20 is connected with the third filter module; the first filter module, the second filter module, the third filter module and the voltage reference stabilizing module are all connected with the AD converter module; the first filter module, the second filter module and the third filter module are for depressing the high frequency noise and allows the wanted low frequency noise to pass through, which improves the accuracy of the test; the voltage reference stabilizing module feeds accurate reference voltage to the AD converter module; the AD converter module is connected with an input end of the single-chip microcomputer; control cables of the hydraulic pump motor assembly 22 and the directional valve 23 are connected with an output end of the single-chip microcomputer; the communication drive module is connected with the single-chip microcomputer; the communication drive module receives signals from the single-chip microcomputer; the first power supply module is connected with the external power supply through a power cord of the water-proof connector 33; the communication drive module is connected with the host computer through a signal cable of the water-proof connector 33; the first power supply module and the second power supply module adopts the DCDC power supply module from GODSEND with the model type WD12-12S12 and WD12-12S05 while other model type is also applicable; the voltage reference stabilizing module adopts REF5050 chip from TI while other model type is also applicable; the communication drive module adopts DS275 from MAXIM; the first filter module, the second filter module and the third filter module adopts MAX291 from MAXIM while other model type is also applicable; the AD converter module adopts THS107 from TI while other model type is also applicable.

Figure 10:
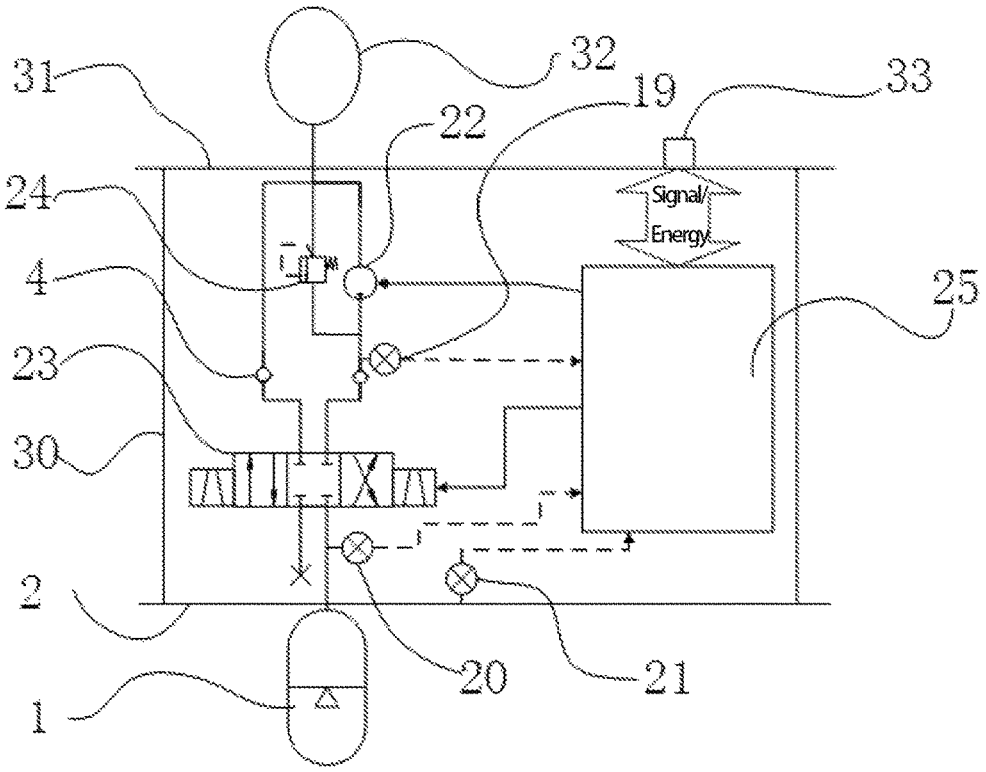
FIG. 10 is the working diagram of the present invention.
Figure 11:
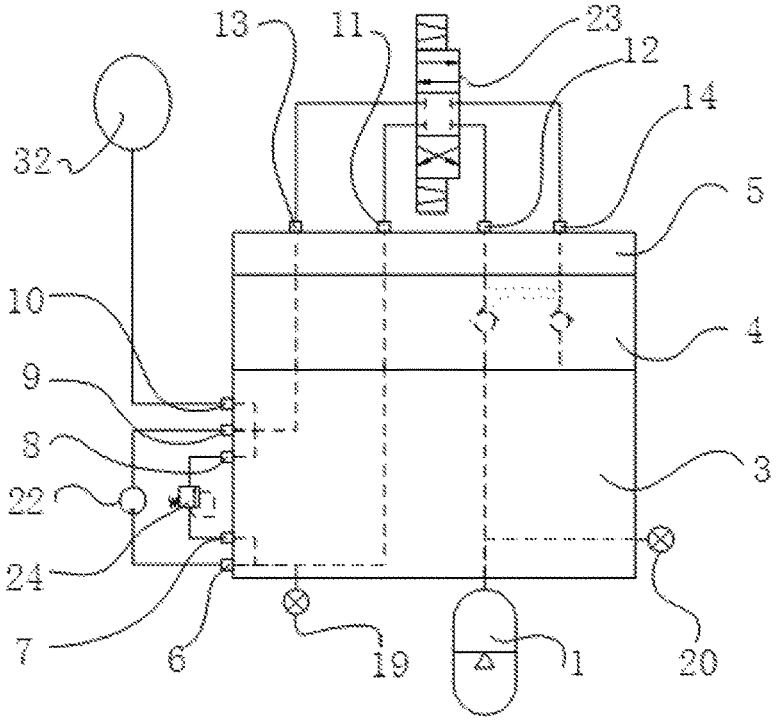
FIG. 11 is the connection diagram of the hydraulic oil channel.

The working process the self-draining oil buoyancy regulating device for underwater robots is as below:

As illustrated in FIG. 10 and FIG. 11, the test result of the accumulator pressure sensor 20 is input to the single-chip microcomputer after converted to digital by the AD converter module and calculated into the volume of the bladder 32 based on the gas equation; as the depth of the sea is proportional to the pressure, the test result of the depth pressure sensor 21 is input to the single-chip microcomputer after converted to digital by the AD converter module and calculated into depth; Based on the two test result, the single-chip microcomputer decide whether to increase, decrease or maintain the volume of the bladder 32 to regulate the buoyancy by changing the displacement.

When to reduce the volume of the bladder 32, the control panel 25 output the control signal to the hydraulic pump motor assembly 22 and the directional valve 23; the hydraulic pump motor 22 is started and pump the oil (if the pump is already started then keep it unchanged); switch the directional valve 23 to the left position; the bladder 32 is connected with oil return outlet of the hydraulic pump assembly 22; the oil outlet of the hydraulic pump assembly 22 is connected with the accumulator 1; the flow of the hydraulic oil is in the same direction with the hydraulic-operated check valve 4; the hydraulic-operated check valve 4 is switched on; the oil inside the bladder 32 is pumped into the accumulator 1 by the hydraulic pump assembly 22; the volume of the bladder is reduced;

When to reduce the volume of the bladder 32, the control panel 25 output the control signal to the hydraulic pump motor assembly 22 and the directional valve 23; the hydraulic pump motor assembly 22 is started and pump the oil (if the pump is already started then keep it unchanged); switch the directional valve 23 to the right position; the oil outlet of the hydraulic pump motor assembly 22 is plugged and connected with the hydraulic-operated check valve 4; the relief valve 24 is parallel with the hydraulic pump assembly 22; the bladder 32 is connected with the accumulator 1 through the hydraulic-operated check valve 4; the hydraulic pump motor assembly 22 is started and generates pressure; when switch on the hydraulic-operated check valve 4 and the bladder 32 is connected with the accumulator 1, the oil inside the accumulator 1 flows into the bladder 32 under the gas pressure and the volume of the bladder is increased; the oil return to the hydraulic pump motor assembly 22 through the relief valve 24 due to the oil outlet is plugged.

There are two ways to keep the volume of the bladder 32 unchanged for varied situation. One is to control the directional valve 23. When the directional valve is switched to middle, the connection between the accumulator 1 and other oil channels is cut off and the oil is not able to enter the accumulator 1. With the assistance of the hydraulic-operated check valve 4 the oil leakage through the crevice of the valve core is reduced. The other way is to control the hydraulic pump motor assembly 22. When the hydraulic pump motor assembly 22 is stopped, the oil inside the bladder 32 is not able to flow into the accumulator 1 due to no pressure generated. The hydraulic-operated check valve 4 is not able to reversely be switched on when there is no pressure and the oil is not able to flow from the accumulator to the bladder 32.

Furthermore, under the process of reducing the volume of the bladder the control panel 25 keeps adjusting the rotational speed of the hydraulic pump motor assembly 22 according to the feedback from the pump outlet pressure sensor 19 to maintain the outlet pressure of the hydraulic pump motor assembly 22. Meanwhile in order to ensure the security, when the feedback from the pump outlet pressure sensor 19 exceeds rated value, the control panel 25 urgently idles all the current tasks, stops the hydraulic pump motor assembly 22, switches the directional valve 23 to middle position and report the abnormal to the host computer.

What is claimed is:

1. A self-draining oil buoyancy regulating device for underwater robots, comprising: an accumulator (1), a lower hatch cover (2), a lower valve block (3), a hydraulic-operated check valve (4), an upper valve block (5), a pump outlet pressure sensor (19), an accumulator pressure sensor (20), a depth-pressure sensor (21), a hydraulic pump motor assembly (22), a directional valve (23), a relief valve (24), a control circuit board (25), a hatch shell (30), an upper hatch cover (31), a bladder (32), a water-proof connector (33) and a host computer, wherein:

the accumulator (1), the lower hatch cover (2), the hatch shell (30), the upper hatch cover (31) and the bladder (32) are fixedly connected in sequence; the water-proof connector (33) is fixed on the upper hatch cover (31);

the depth-pressure sensor (21) is mounted on the lower hatch cover (2) to measure an underwater pressure; the upper valve block (5), the hydraulic-operated check valve (4) and the lower valve block (3) are connected through piping in sequence; the lower valve block (3) is fixed on the lower hatch cover (2);

the pump outlet pressure sensor (19) and the accumulator pressure sensor (20) are mounted on the lower valve block (3); the directional valve (23) and the upper valve block (5) are connected through piping; the hydraulic pump motor assembly (22) and the relief valve (24) are both connected with the lower valve block (3) through piping;

the depth-pressure sensor (21), the pump outlet pressure sensor (19) and the accumulator pressure sensor (20) are all connected with the control circuit board (25); the control circuit board (25) is connected with an external power supply and the host computer respectively by the water-proof connector (33).

2. The self-draining oil buoyancy regulating device for the underwater robots, as recited in claim 1, wherein on a top surface of the lower valve block (3) there are a lower valve block $10^{th}$ port (44), a lower valve block $11^{th}$ port (45) and a lower valve block $12^{th}$ port (46); on sides of the lower valve block (3) there are a lower valve block $2^{nd}$ port (36), a lower valve block $3^{rd}$ port (37), a lower valve block $4^{th}$ port (38), a lower valve block $5^{th}$ port (39), a lower valve block $6^{th}$ port (40), a lower valve block $7^{th}$ port (41), a lower valve block $8^{th}$ port (42) and a lower valve block $9^{th}$ port (43); on a bottom surface of the lower valve block (3) there is a lower valve block $1^{st}$ port (35); inside the lower valve block (3) there are runners, wherein the lower valve block $2^{nd}$ port (36), the lower valve block $3^{rd}$ port (37), the lower valve block $9^{th}$ port (43) and the lower valve block $12^{th}$ port (46) are connected by a first runner; the lower valve block $1^{st}$ port (35), the lower valve block $7^{th}$ port (41), the lower valve block $8^{th}$ port (42) and the lower valve block $11^{th}$ port (45) are connected by a second runner; the lower valve block $4^{th}$ port (38), the lower valve block $5^{th}$ port (39), the lower valve block $6^{th}$ port (40) and the lower valve block $10^{th}$ port (44) are connected by a third runner;

wherein the lower valve block $1^{st}$ port (35) is connected with the accumulator (1) through the lower hatch cover (2); the lower valve block $2^{nd}$ port (36) is connected with an oil draining outlet of the hydraulic pump motor assembly (22); the lower valve block $3^{rd}$ port (37) is connected with an oil inlet of the relief valve (24); the lower valve block $4^{th}$ port (38) is connected with an oil outlet of the relief valve (24); the lower valve block $5^{th}$ port (39) is connected with an oil return outlet of the hydraulic pump motor assembly (22); the lower valve block $6^{th}$ port (40) is connected with the bladder (32); the lower valve block $7^{th}$ port (41), the lower valve block $8^{th}$ port (42) and the lower valve block $9^{th}$ port (43) are blocked; the lower valve block $10^{th}$ port (44)

is connected with an oil return outlet of the hydraulic-operated check valve (4); the lower valve block $11^{th}$ port (45) is connected with a first working port of the hydraulic-operated check valve (4); the lower valve block $12^{th}$ port (46) is connected with an oil inlet of the hydraulic-operated check valve (4).

3. The self-draining oil buoyancy regulating device for the underwater robots, as recited in claim 2, wherein on the upper valve block (5) there are an upper valve block $1^{st}$ port (47), an upper valve block $2^{nd}$ port (48), an upper valve block $3^{rd}$ port (49), an upper valve block $4^{th}$ port (50); wherein a second working port of the directional valve (23) is connected with a second working port of the hydraulic-operated check valve (4) through the upper valve block $1^{st}$ port (47); an oil outlet of the directional valve (23) is connected with an oil return outlet of the hydraulic-operated check valve (4) through the upper valve block $2^{nd}$ port (48); a first working port of the directional valve (23) is connected with the first working port of the hydraulic-operated check valve (4) through the upper valve block $3^{rd}$ port (49); an oil inlet of the directional valve (23) is connected with the oil inlet of the hydraulic-operated check valve (4) through the upper valve block $4^{th}$ port (50).

4. The self-draining oil buoyancy regulating device for the underwater robots, as recited in claim 1, wherein the control circuit board (25) further comprises: a first power supply module, a second power supply module, a communication drive module, a voltage reference stabilizing module, a first filter module, a second filter module, a third filter module, an AD (Analog-to-digital) converter module and single-chip microcomputer; wherein the first power supply module transfers an external 12V power supply to an internal 12V power supply inside the control panel; the second power supply module transfers the internal 12V power supply inside the control panel to a 5V power supply for the single-chip microcomputer; the first power supply module is connected to the second power supply module and the voltage reference stabilizing module respectively; input ends of a power supply of the pump outlet pressure sensor (19), the accumulator pressure sensor (20), the depth-pressure sensor (21), the hydraulic pump motor assembly (22) and the directional valve (23) are all connected with the second power supply module; a signal cable of the depth-pressure sensor (21) is connected with the first filter module; a signal cable of the pump outlet pressure sensor (19) is connected with the second filter module; a signal cable of the accumulator pressure sensor (20) is connected with the third filter module; the first filter module, the second filter module, the third filter module and the voltage reference stabilizing module are all connected with the AD converter module; the AD converter module is connected with an input end of the single-chip microcomputer; control cables of the hydraulic pump motor assembly (22) and the directional valve (23) are connected with an output end of the single-chip microcomputer; the communication drive module is connected with the single-chip microcomputer; the first power supply module is connected with the external power supply through a power cord of the water-proof connector (33); the communication drive module is connected with the host computer through a signal cable of the water-proof connector (33).

* * * * *